United States Patent [19]

Lee et al.

[11] Patent Number: 4,739,185

[45] Date of Patent: Apr. 19, 1988

[54] PULSE GENERATING CIRCUIT FOR AN IGNITION SYSTEM

[75] Inventors: Michael J. Lee, Rowington; Philip R. Wentworth, Birmingham, both of Great Britain

[73] Assignee: Lucas Industries Public Limited Company, Birmingham, Great Britain

[21] Appl. No.: 942,288

[22] Filed: Dec. 16, 1986

[30] Foreign Application Priority Data

Jan. 7, 1986 [GB] United Kingdom ..... 8600270
Apr. 29, 1986 [GB] United Kingdom ..... 8610495

[51] Int. Cl.[4] ..... F02P 5/00

[52] U.S. Cl. ..... 307/106; 307/9; 307/10 R; 123/605; 123/602; 123/620; 315/209 SC

[58] Field of Search ..... 307/106, 107, 108, 109, 307/110; 123/596, 597, 600, 601, 602, 604, 605, 606, 620, 621, 653, 654, 655, 656, 648; 315/209 R, 209 CD, 209 M, 209 SC, 214, 223, 225, 226

[56] References Cited

U.S. PATENT DOCUMENTS

| | | | |
|---|---|---|---|
| 3,504,658 | 4/1970 | Chavis | 123/656 X |
| 3,809,041 | 5/1974 | Kato et al. | 123/602 |
| 3,824,429 | 7/1974 | Davalillo | 315/209 CD X |
| 3,937,190 | 2/1976 | Katsumata | 123/602 |
| 3,980,922 | 9/1976 | Katsumata et al. | 315/209 SC X |
| 4,132,208 | 1/1979 | Yukawa | 315/209 SC X |
| 4,150,652 | 4/1979 | Nagasawa | 123/602 |
| 4,170,208 | 10/1979 | Katsumata et al. | 123/602 |
| 4,201,171 | 5/1980 | Nanjo et al. | 315/209 SC X |
| 4,232,646 | 11/1981 | Asai | 315/209 SC X |
| 4,258,296 | 3/1981 | Gerry | 315/209 |
| 4,369,758 | 1/1983 | Endo | 123/620 |
| 4,407,259 | 10/1983 | Abo | 123/621 X |
| 4,418,660 | 12/1983 | Endo et al. | 123/606 X |
| 4,445,491 | 5/1984 | Ishikawa et al. | 123/620 X |
| 4,510,915 | 4/1985 | Ishikawa et al. | 123/620 |

FOREIGN PATENT DOCUMENTS

| | | |
|---|---|---|
| 57-2470 | 1/1982 | Japan . |
| 00885 | 4/1981 | PCT Int'l Appl. . |
| 2085523 | 4/1982 | United Kingdom . |
| 2099917A | 12/1982 | United Kingdom . |
| 2101208 | 1/1983 | United Kingdom . |

*Primary Examiner*—William M. Shoop, Jr.
*Assistant Examiner*—Paul Ip
*Attorney, Agent, or Firm*—Holman & Stern

[57] ABSTRACT

A pulse generating circuit for a plasma ignition system includes a thyristor connected between a supply terminal and earth. A primary winding (Wp) of a transformer (TR) and a first capacitor ($C_1$) are connected across the thyristor. The supply terminal is also connected through a secondary winding ($W_s$) and a diode (D) to an output terminal. A saturable core inductor (L) and a second capacitor ($C_2$) are connected in series across the output terminal and earth. A plasma plug is also connected across the output terminal and earth. In operation, the first and second capacitors are charged and the thyristor is fired. A high voltage pulse is applied by the secondary winding ($W_s$) to the plasma plug causing electric breakdown. The second capacitor ($C_2$) then discharges through the inductor (L) and the plasma plug. Four alternative circuits are also described.

8 Claims, 4 Drawing Sheets

PULSE GENERATING CIRCUIT FOR AN IGNITION SYSTEM

This invention relates to a pulse generating circuit for an ignition system, and particularly, but not exclusively, for a plasma ignition system for an internal combustion engine.

In a plasma ignition system, each cylinder is provided with a plasma ignition plug. In a plasma plug, a gap between an insulated electrode and a grounded electrode is surrounded by a cavity having a small orifice. Each time ignition is required, a low energy, high voltage pulse is applied across the electrodes. This low energy, high voltage pulse causes electric breakdown to occur and permits a high energy, low voltage discharge to occur across the gap. Rapid expansion of the gas within the cavity causes a plasma jet to be ejected from the orifice into the cylinder thereby causing ignition to occur.

In GB-A-2099917, there is shown a pulse generating circuit for a plasma ignition system. In this circuit, a voltage supply source is connected through a diode, a capacitor for storing ignition energy, and a second diode to earth. The junction of the ignition energy capacitor and the second diode is connected through the primary winding of a voltage step up transformer and an auxillary capacitor to earth. This junction is also connected through a secondary winding of the transformer to the insulated electrode of a plasma ignition plug. The junction of the first diode and the ignition engery capacitor is connected through a thyristor to earth. When the thyristor is rendered conductive, an oscillatory voltage is established in the primary winding of the transformer. This voltage is increased by the turns ratio of the transformer and applied to the ignition plug to cause electric breakdown. When electric breakdown has occurred, the energy stored in the ignition energy capacitor is supplied through the secondary winding of the transformer to the gap in the plug thereby causing ignition to occur.

The circuit suffers from two disadvantages. Firstly, this circuit places conflicting requirements on the design of the transformer. In order to obtain a sufficiently high voltage to achieve electric breakdown, the transformer should have a high turns ratio. However, the inductance of the primary winding should be sufficiently large to prevent destruction of the thyristor by an excessive rate of change of current with respect of time when the thyristor is rendered conductive and the secondary winding should have an inductance which is low enough to permit sufficient ignition energy to pass from the energy storage capacitor to the ignition plug. Secondly, in this circuit the current discharged from the ignition energy capacitor passes through the thyristor so the thyristor must be capable of sustaining this current.

It is an object of this invention to provide a new or improved pulse generating circuit for ignition system in which the above mentioned disadvantages are overcome or reduced.

According to one aspect of this invention there is provided a pulse generating circuit for an ignition system, said pulse generating circuit comprising a supply input terminal, an output terminal, an earth terminal, a first series circuit comprising a switch element, a primary winding of a voltage step up transformer and a first capacitor connected in series, and a second series circuit comprising an inductor and a second capacitor connected in series across the output terminal and the earth terminal, both said first and second capacitors being arranged to be charged from the supply input terminal and said transformer having a secondary winding connected to supply high voltage pulses to said output terminal.

In operation, the output terminal and earth terminal may be connected across a plasma ignition plug. Each time the switch element is rendered conductive, an oscillatory current commences to flow in the first series circuit thereby causing the secondary winding of the transformer to apply an initial high voltage pulse across the electrodes of the plug. This initial high voltage pulse causes electric breakdown in the gap between the plug electrodes thereby reducing the impedance between these electrodes. The second series circuit then supplies energy stored in the second capacitor to the gap thereby causing ignition to occur. The circuit components are selected so that the resonant frequency of the first series circuit is much higher than the resonant frequency of the second series circuit and so that the second series circuit presents a high impedance to the initial high voltage pulse. Consequently, the second series circuit absorbs substantially zero energy from this initial high voltage pulse.

In the circuit of the present invention, the conflicting requirements on the design of the transformer are avoided. The second capacitor stores the ignition energy and the current which flows from this capacitor does not flow through the secondary winding of the transformer. Consequently, the transformer can be designed so that the impedance of the primary winding is sufficiently high to prevent an excessive rate of rise of current when the switch element is rendered conductive and the turns ratio may be made large enough to achieve electric breakdown. Also, the current which causes ignition to occur does not flow through the switch element.

Preferably, the inductor is a saturable core inductor.

The use of a saturable core inductor permits the inductor to have a much higher inductance during the initial high voltage pulse than during passage of the current from the second capacitor.

In one arrangement, in the first series circuit, one side of the first capacitor is connected to the earth terminal, one side of the switch element is connected to the earth terminal, the other side of the first capacitor is connected through the primary winding to the other side of the switch element, one of the junctions of the first capacitor and the primary winding and the junction of the switch element and the primary winding is connected in common to the supply input terminal and one end of the secondary winding, and the other end of the secondary winding is connected through at least one diode to the output terminal.

In another arrangement, said supply input terminal is connected through at least one diode to the junction of said inductor and said second capacitor.

The secondary winding of said transformer may be connected across said inductor and arranged to supply high voltage pulses to said output terminal with the opposite polarity to the polarity of the voltage supplied to the output terminal by said second capacitor.

According to another aspect of this invention, there is provided an ignition system for an internal combustion engine, said system comprising at least one pulse generating circuit according to the first aspect of this invention, the or each pulse generating circuit having an ignition plug connected to its output terminal, a voltage supply source connected to the input supply terminal of the or each pulse generating circuit, and a timing signal generator, a control terminal of the switch element of the or each pulse generating circuit being connected to a respective output of the timing signal generator.

This invention will now be described in more detail, by way of example, with reference to the drawings in which.

Figure 1:
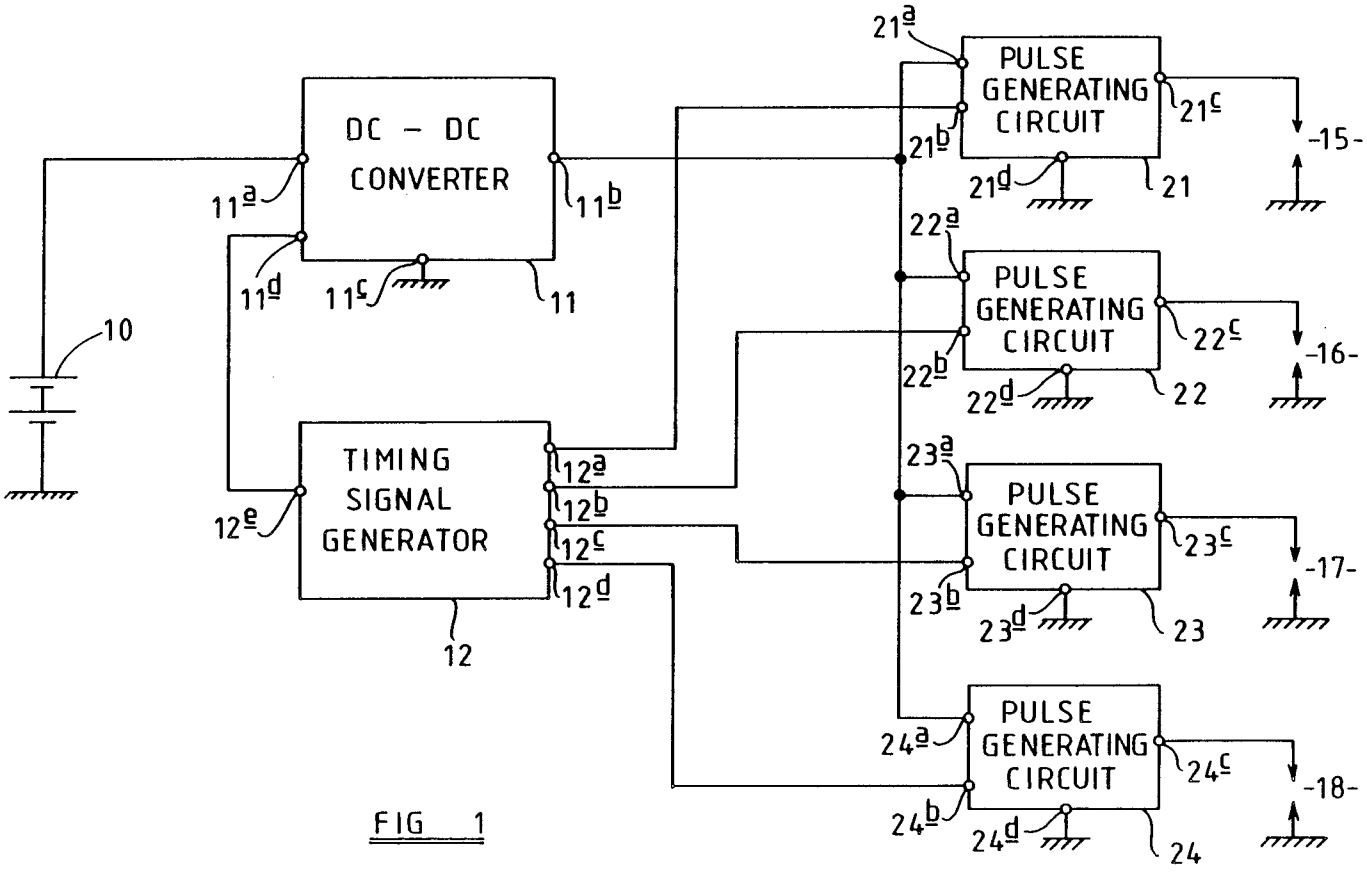
FIG. 1 is a block diagram of a plasma ignition system embodying this invention.

Referring now to FIG. 1, there is shown a plasma ignition system for a motor vehicle internal combustion engine. The system includes a motor vehicle 12 V battery 10, the negative terminal of which is connected to the vehicle earth and the positive terminal of which is connected to an input terminal 11$^a$ of a DC—DC converter 11. The DC—DC converter 11 is of a well known design and includes an earth terminal 11$^c$, an output terminal 11$^b$ provided an output voltage at 1 kV, and a control terminal 11$^d$. The system also includes a timing signal generator 12 which is of well known construction and which is responsive to the position of the engine crankshaft, crankshaft speed, and engine manifold vacuum pressure. The signal generator 12 produces pulses at outputs 12$^a$ to 12$^d$ for triggering ignition in the four engine cylinders, and a control signal at an output 12$^e$ which is connected to the control terminal 11$^d$ of converter.

The system further includes four plasma ignition plugs 15 to 18 mounted respectively in the four cylinders. Each of the plugs 15 to 18 has a grounded electrode and an insulated electrode. The plugs 15 to 18 are associated respectively with four pulse generating circuits 21 to 24. The pulse generating circuits 21 to 24 are provided respectively with supply input terminals 21$^a$ to 24$^a$ connected to the output terminal 11$^b$ of DC—DC converter 11, control terminals 21$^b$ to 24$^b$ connected to the outputs 12$^a$ to 12$^d$ of the timing signal generator 12, output terminals 21$^c$ to 24$^c$ connected to the insulated electrodes of plugs 12 to 18, and earth terminals 21$^d$ to 24$^d$.

The pulse generating circuits 21 to 24 are each of identical design and the circuit 21 will now be described with reference to FIG. 2.

Figure 2:
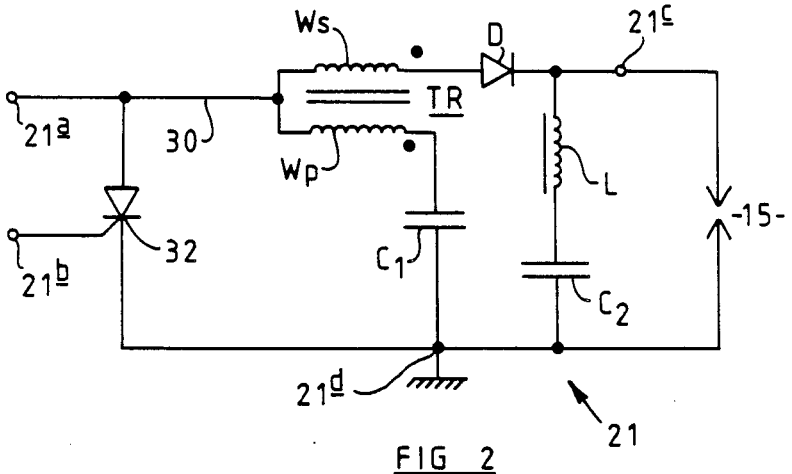
FIG. 2 is a circuit diagram of a pulse generating circuit forming part of the ignition system of FIG. 1.

As shown in FIG. 2, the input supply terminal 21$^a$ is connected to a rail 30. Rail 30 is connected to the anode of a thyristor 32, the cathode of which is connected to the earth terminal 21$^d$ and the gate of which is connected to the control input terminal 21$^b$. The thyristor 32 operates as a switch element. Rail 30 is further connected through primary winding $W_p$ of a voltage step up transformer TR and a capacitor $C_1$ to the earth terminal 21$^d$. The thyristor 32, primary winding $W_p$ and capacitor $C_1$ thus form a first series circuit. The rail 30 is also connected through a secondary winding $W_s$ and a diode D to the output terminal 21$^c$. The output terminal 21$^c$ is connected through a saturable core inductor L and a capacitor $C_2$ to the earth terminal 21$^d$. The inductor L and capacitor $C_2$ form a second series circuit. As will be explained, the capacitor $C_2$ stores the energy required for ignition.

In operation, initially the capacitors $C_1$ and $C_2$ are both charged to the supply potential of 1 kV. At the instant the thyristor 32 is triggered, an oscillatory current commences to flow in the first series circuit comprising thyristor 32, winding $W_p$ and capacitor $C_1$ at a resonant frequency $f_{trig}$ given by the following equation:

$$f_{trig} = \tfrac{1}{2}\pi \sqrt{(L_p C_1)}$$

where Lp is the inductance of primary winding $W_p$ and $C_1$ is the capacitance of capacitor $C_1$.

The voltage appearing across the primary winding $W_p$ will be magnified by the turns ratio of transformer TR. Consequently, during the first quarter cycle of this oscillatory current, the secondary winding $W_s$ applies an initial high voltage pulse through diode D to the gap of plug 15 thereby causing electric breakdown.

During this initial high voltage pulse, the core of inductor L is in an unsaturated state. With inductor L in this state, the component values of inductor L and capacitor $C_2$ are chosen so that the resonant frequency of the circuit formed from inductor L and capacitor $C_2$ is much lower than $f_{trig}$ so that this second circuit has a high impedance at the frequency $f_{trig}$. Consequently, the second series circuit of inductor L and capacitor $C_2$ absorbs substantially zero energy from the initial high voltage pulse.

After electric breakdown has occurred, the impedance of the gap of plug 15 becomes low allowing capacitor $C_2$ to discharge its energy via inductor L across this gap thereby causing ignition. Capacitor $C_2$ discharges through inductor L at a high current thereby causing its core to saturate. Consequently, during passage of a high current, the inductance of inductor L is much lower than during the initial high voltage pulse. The diode D prevents the capacitor $C_2$ from discharging through secondary winding $W_s$.

It will be appreciated that it will be necessary to inhibit the action of the DC—DC converter 11 during triggering in order to protect the thyristor 32.

In the circuit described above, the components have the following values:

$C_1 = 0.1\ \mu F$
$L_p = 18\ \mu H$
$C_2 = 2.0\ \mu F$
$L_{init} = 6.6$ mH
$L_{sat} = 37.5\ \mu H$ where $C_2$ is the capacitance of capacitor $C_2$, $L_{init}$ is the inductance of inductor L when the core is unsaturated, and $L_{sat}$ is the inductance when the core is saturated.

With these values, the resonant frequency $f_{trig}$ is 119 kHz. The resonant frequency of the series circuit comprising inductor L and capacitor $C_2$ when the core of the inductor is unsaturated is 1.4 kHz and so this is substantially lower than $f_{trig}$. The resonant frequency of the series circuit comprising the gap of plug 15, inductor L when the core is saturated and capacitor $C_2$ during discharge of the capacitor $C_2$ is 18 kHz. The capacitor $C_2$ will discharge the ignition energy in approximately half a cycle and so this provides a discharge time of at least 27 μs, the exact discharge time depending on the nature of the saturable core material.

Figure 3:
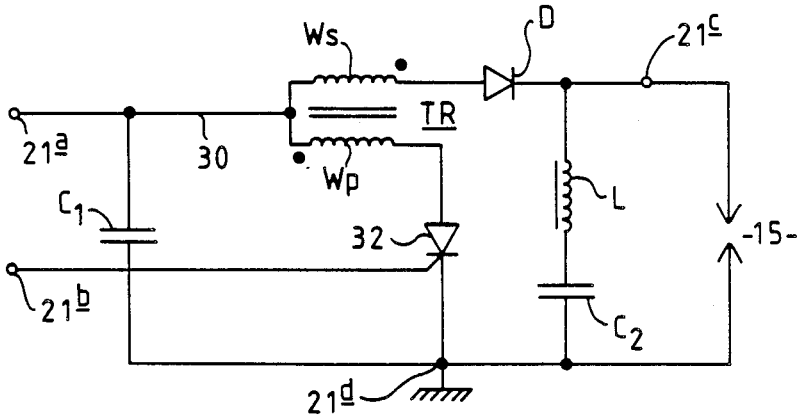
FIGS. 3 to 7 are circuit diagrams of alternative pulse generating circuits for the system of FIG. 1.

FIG. 3 shows a modification of the circuit of FIG. 2 and like parts have been denoted by the same references. However, in comparison with the circuit of FIG.

2, the thyristor 32 and capacitor $C_1$ have been interchanged. With this modification, the inductance of the primary winding $W_p$ protects the thyristor 32 from a high rate of rise of current with respect to time supplied from the capacitance of the DC—DC converter 11.

Although the pulse generating circuits described in FIGS. 2 and 3 have been found to be generally satisfactory, they suffer from a number of disadvantages. Firstly, the charging current for the capacitor $C_2$ passes through the inductor L. In practice, the charging current is sufficient to saturate the core of the inductor L so the flux density is left at the remanence value. Consequently, the material for the core must be chosen carefully so as to avoid saturation during the high voltage pulse. Secondly, the charging current for the capacitor $C_2$ passes through the secondary winding $W_s$ of the transformer TR so there is energy loss in the resistance associated with this secondary winding. A pulse generating circuit will now be described with reference to FIG. 4 which overcomes these disadvantages.

Figure 4:
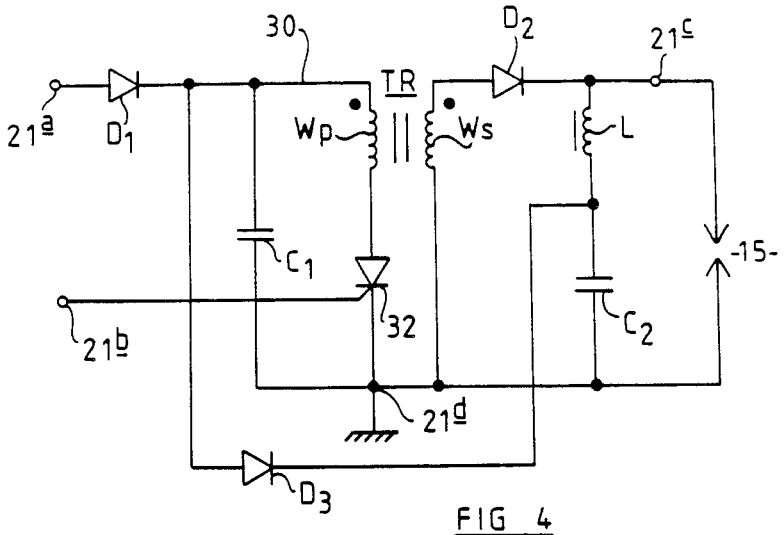

In FIG. 4 the supply input terminal is connected through a diode $D_1$ to the rail 30. The capacitor $C_1$, primary winding $W_p$ and the thyristor 32 are connected as in FIG. 3. Also, as in FIG. 3, the inductor L and capacitor $C_2$ are connected across the output terminal $21^c$ and the earth terminal. However, in FIG. 4, the earth terminal is connected through the secondary winding $W_s$ and a diode $D_2$ to the output terminal $21^c$. Also, the rail 30 is connected through a diode $D_3$ to the junction of inductor L and capacitor $C_2$.

The overall operation of the circuit of FIG. 4 is generally similar to that of FIG. 2 and 3. However, because the charging current for capacitor $C_2$ is supplied directly via diode $D_3$, the charging current does not flow through inductor L or secondary winding $W_s$. Consequently, the charging current does not cause the core of the inductor L to saturate and there is no energy loss in the secondary winding $W_s$.

In the circuit of FIG. 4, the components have the following values:

$C_1 = 0.1\ \mu F$
$L_p = 18\ \mu H$
$C_2 = 2.0\ \mu H$
$L_{init} = 6.6$ mH
$L_{sat} = 37.5\ \mu H$ With these values, the resonant frequency $f_{trig}$ is 119 kHz. The resonant frequency of the series circuit comprising inductor L and capacitor $C_2$ when the core of the inductor is unsaturated is 1.4 kHz and so this is substantially lower than $f_{trig}$.

The resonant frequency of the series circuit comprising the gap of plug 15, inductor L and capacitor $C_2$ when the core is saturated during discharge of the capacitor $C_2$ is 18 kHz. The capacitor $C_2$ will discharge the ignition energy in approximately half a cycle and so this provides a discharge time of at least 27 μs.

In the circuit shown in FIG. 4, after capacitor $C_2$ has discharged, the core of inductor L will be left with its flux density at the remanence value. For some core materials, the remanence value is close to the saturation value and so, with such materials, the inductor L will present a low initial inductance to each high voltage pulse.

Figure 5:
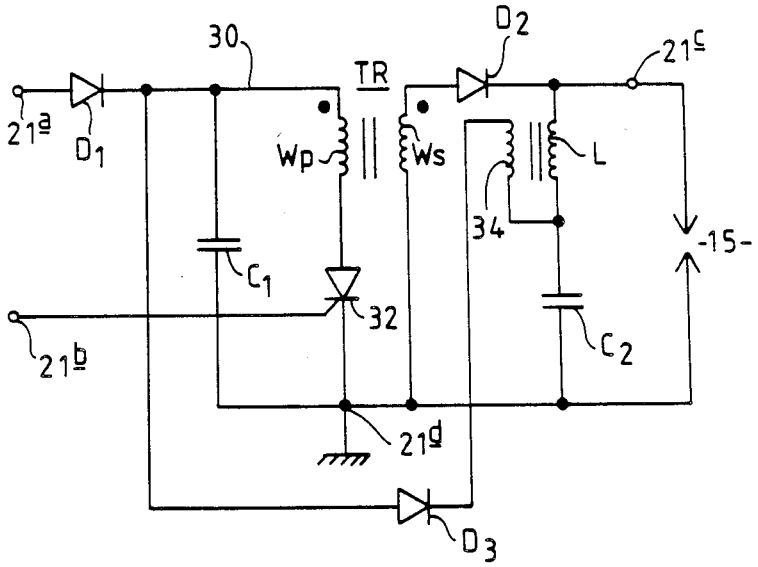

In order to overcome this, as shown in FIG. 5, the diode $D_3$ may be connected to the junction of inductor L and capacitor $C_2$ through a reset winding 34 associated with the inductor L. With this modification, after charging capacitor $C_2$, the core of inductor L is reset to a value which is remote from the saturation value. Consequently, the inductor L presents a relatively high initial inductance to each high voltage pulse, and the impedance of the series circuit comprising inductor L and capacitor $C_2$ is increased and the load on transformer TR is decreased. Apart from this modification, the circuit of FIG. 5 is identical to that of FIG. 4.

In the example shown in FIGS. 4 and 5, a flux reversal occurs in inductor L between the initial high voltage pulse and the discharge current of capacitor $C_2$ because the polarity of the high voltage pulse with respect to ground is the same as the polarity of the voltage of capacitor $C_2$. This flux reversal causes a time delay and there is a risk that this time delay may be sufficient to permit the gas in the plug to recover from its breakdown state thereby preventing capacitor $C_2$ from discharging at a high current. This problem is overcome in the circuit shown in FIG. 6.

Figure 6:
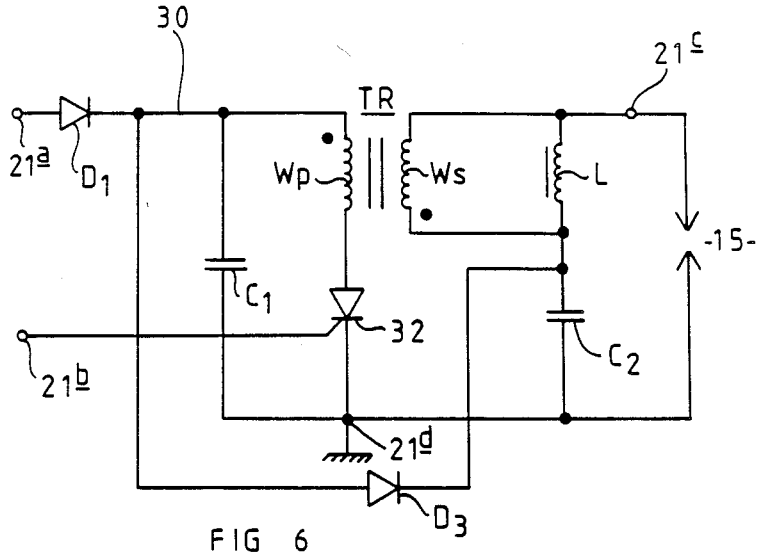

The circuit shown in FIG. 6 is generally similar to that of FIG. 4 and like elements have been referenced in the same way. However, in the circuit of FIG. 6, the polarity of the secondary winding $W_s$ is reversed and this winding is connected directly across inductor L and diode $D_2$ is eliminated. With the arrangement shown in FIG. 6, the high voltage pulse on the secondary winding $W_s$ causes current to flow through inductor L in the same direction as the high current from capacitor $C_2$. Consequently there is no flux reversal. The secondary winding $W_s$ is connected directly across inductor L to prevent capacitor $C_2$ discharging through it.

In the circuit shown in FIG. 5, the transformer TR has a gapped core formed from Ferroxcube ETD 49 A16 (3C8) grade ferrite with a core gap of 5.77 mm. The primary winding comprises 10 turns of trifilar wound 0.711 mm diameter enamelled copper wire. This gives the primary an inductance value of 15 μH which is the minimum value required to prevent the thyristor 32 from an excessive rate of charge of current with respect to time. The air gap is sufficient to prevent the core from saturating. The secondary winding comprises 300 turns of 0.2 mm diameter enamelled copper wire wound on an eight section polytetrafluourethylene former.

The inductor L has a torroidal core formed from an iron based amorphous alloy (Muglass type LL) having an external diameter of 69.22 mm and an internal diameter of 42.16 mm. This core is supplied by Telcon Metals Limited of Crawley, Sussex. The winding of inductor L comprises 170 turns of 0.457 mm diameter enamelled copper wire. With this construction, the inductance is 40 μH when the core is saturated.

Figure 7:
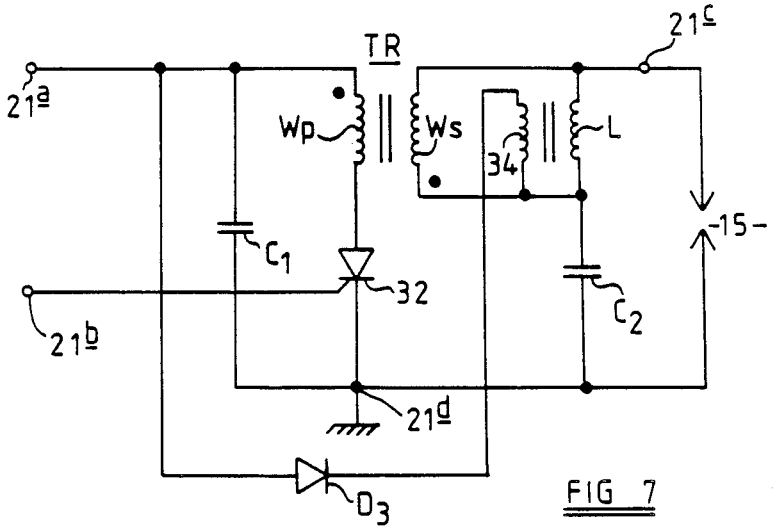

In the arrangement shown in FIG. 6, the reactance of inductor L must be sufficient to prevent significant current flow through inductor L during the high voltage pulse. For the inductance to stay at a high value during the high voltage pulse, it is essential that the core does not saturate at this time. In the core material for inductor L, the ratio of the remanence to the saturation flux density is 0.07 and this provides sufficient flux excursion between the remanence and the saturation flux value to prevent saturation during the high voltage pulse. However, if it is desired to use a material which has a smaller available flux excursion between remanence and saturation, the charging current to capacitor C2 may be supplied through a reset winding associated with inductor L in order to cause flux reversal and increase the available flux change when the next high voltage pulse is applied. This possiblity is illustrated in FIG. 7 where the reset winding is designated by reference numeral 34.

Although the circuit of FIG. 1 is described with reference to a four cylinder internal combustion engine, it could be used with combustion engines having a different number of cylinders, for example one cylinder or six cylinders.

Although the pulse generating circuits of FIGS. 2 to 7 have been described with reference to a plasma ignition system, the circuits are not limited to use for such a system. For example, these circuits could be used with a conventional spark ignition system or with ignition plugs in a diesel engine and will provide improved performance over conventional pulse generating circuits when so used.

We claim:

1. A pulse generating circuit for an ignition system, comprising:

an output terminal;

a high voltage supply source having a supply terminal and a ground terminal;

a step-up transformer having a primary winding and a secondary winding;

a first series circuit of a switch element and a first capacitor respectively connecting opposite ends of the primary winding of the step-up transformer to the ground terminal, one end of the primary winding being also connected to the supply terminal of the high voltage supply source for providing a current path for charging the first capacitor from the high voltage supply source, the secondary winding of the step-up transformer being connected to the output terminal for supplying a high voltage pulse to the output terminal when the first capacitor is discharged through the primary winding on closure of the switch element; and a second series circuit of a second capacitor and an inductor connected in series with one another between the output terminal and the ground terminal, a charging circuit being provided between the supply terminal of the high voltage supply source and the second capacitor for current for charging the second capacitor from the high voltage supply source, said inductor being saturable and providing, when saturated, a low impedance path for current from the second capacitor to the output terminal, and, when not saturated, exhibiting sufficient inductance for effectively preventing dissipation of high voltage pulses from the secondary winding into the second capacitor.

2. A pulse generating circuit as claimed in claim 1 in which, in the first series circuit, one side of the first capacitor is connected to the ground terminal, one side of the switch element is connected to the ground terminal, the other side of the first capacitor is connected through the primary winding to the other side of the switch element, one of the junctions of the first capacitor and the primary winding and the junction of the switch element andthe primary winding is connected in common to the supply terminal and one end of the secondary winding, and the other end of the secondary winding is connected through at least one diode to the output terminal.

3. A pulse generating circuit as claimed in claim 1 in which said supply terminal is connected through at least one diode to the junction of said inductor and said second capacitor.

4. A pulse generating circuit as claimed in claim 1 in which the secondary winding of said transformer is connected across said inductor and arranged to supply high voltage pulses to said output terminal with the opposite polarity to the polarity of the voltage supplied to the output terminal by said second capacitor.

5. An ignition system for an internal combustion engine, comprising;

at least one pulse generating circuit, each said pulse generating circuit having a supply input terminal, an output terminal, a ground terminal, an ignition plug connected to its output terminal, a first series circuit including a switch element, a primary winding of a voltage step-up transformer and a first capacitor connected in series, and a second series circuit including an inductor and a second capacitor connected in series across the output terminal and the ground terminal, both said first and second capacitors being arranged to be charged from the supply input terminal, said transformer having a secondary winding connected to supply high voltage pulses to said output terminal, said inductor being saturable and providing, when saturated, a low impedance path for current from said second capacitor to said output terminal, and, when not saturated, exhibiting sufficient inductance for effectively preventing dissipation of high voltage pulses from said secondary winding into said second capacitor;

a voltage supply source connected to the input supply terminal of each said pulse generating circuit; and a timing signal generator, a control terminal of the switch element of each said pulse generating circuit being connected to a respective output of the timing signal generator.

6. An ignition system circuit as claimed in claim 5 in which, in each said pulse generating circuit, in the first series circuit, one side of the first capacitor is connected to the gound terminal, one side of the switch element is connected to the ground terminal, the other side of the first capacitor is connected through the primary winding to the other side of the switch element, one of the junctions of the first capacitor and the primary winding and the junction of the switch element and the primary winding are connected in common to the supply input terminal and one end of the secondary winding, and the other end of the secondary winding is connected through at least one diode to the output terminal.

7. An ignition system as claimed in claim 5 in which, in each said pulse generating circuit, said supply input terminal is connected through at least one diode to the junction of said inductor and said second capacitor.

8. An ignition system as claimed in claim 5 in which, in each said pulse generating circuit, the secondary winding of said transformer is connected across said inductor and arranged to supply high voltage pulses to said output terminal with an opposite polarity to the polarity of the voltage supplied to the output terminal by said second capacitor.

* * * * *